United States Patent [19]

Schedele et al.

[11] Patent Number: 4,567,457

[45] Date of Patent: Jan. 28, 1986

[54] ELECTROMAGNETIC RELAY

[75] Inventors: Helmut Schedele, Diessen; Rolf-Dieter Kimpel, Unterschweinbach, both of Fed. Rep. of Germany

[73] Assignee: Siemens Aktiengesellschaft, Berlin & Munich, Fed. Rep. of Germany

[21] Appl. No.: 638,497

[22] Filed: Aug. 7, 1984

[30] Foreign Application Priority Data

Aug. 12, 1983 [DE] Fed. Rep. of Germany ..... 3329239

[51] Int. Cl.[4] ..... H01H 51/06; H01H 67/02

[52] U.S. Cl. ..... 335/128; 335/202

[58] Field of Search ..... 335/128, 135, 187, 202

[56] References Cited

U.S. PATENT DOCUMENTS 4,272,745 6/1981 Tanaka et al. ..... 335/128

*Primary Examiner*—Harold Broome

*Attorney, Agent, or Firm*—Hill, Van Santen, Steadman & Simpson

[57] ABSTRACT

An electromagnetic relay is provided which has a core yoke embedded in a base body, the core yoke comprising a yoke leg at both coil ends which proceed perpendicular to the coil axis. A U-shaped armature has its first lateral leg seated on the first yoke leg and has its second lateral leg forming an operating air gap relative to the second yoke leg. A contact and bearing spring is secured to the armature, the contacting end of the contact and bearing spring laterally embracing the armature and the core yoke and interacting at that side of the core yoke which lies opposite the armature with at least one cooperating contact plate.

11 Claims, 12 Drawing Figures

ELECTROMAGNETIC RELAY

BACKGROUND OF THE INVENTION

1. Field of the Invention

The invention relates to electromagnetic relays and more particularly to electromagnetic relays comprising a coil body carrying a winding.

2. Description of the Prior Art

Electromagnetic relays comprsing a coil body carrying a winding are known, for example, from U.S. Pat. No. 4,272,745. There, a stirrup-shaped armature has both ends seated on a stirrup-shaped core such that it executes pivot motions approximately around the coil axis. Additional, non-magnetic bearing elements must be provided in the bearing region in this system so that the armature does not short-circuit the yoke in its dropped-out condition. Further, this known relay contains a relatively large number of piece parts in order to transmit the armature motion onto the contact spring via an actuating member. Therefore, both the volume as well as the manufacturing outlay are relatively high for this known relay.

SUMMARY OF THE INVENTION

An object of the present invention is to provide a relay comprising a simple, yet effective magnet system and comprising a contact unit such that a compact format and, thus, a low volume is achieved with few simple parts, whereby an upright assembly as well as a flat assembly of the cuboid relay is possible given the same basic format by means of slight modifications to individual parts.

A relay is provided with a coil body or base body carrying a winding with a core yoke, having its center section embedded in the base body, comprising a yoke leg extending perpendicularly relative to the coil axis at both ends outside of the coil winding. A U-shaped armature is seated on the core yoke, the central part thereof residing parallel to the coil axis and embracing the coil winding. The armature has two lateral legs extending essentially perpendicular to the coil axis. Upon the use of such a relay, the object of the present invention is inventively achieved in that the armature has its first lateral leg seated on the first yoke leg so as to be pivotable around an axis perpendicular to the coil axis and has its second lateral leg forming a working air gap relative to the second yoke leg. Further, a contact spring is secured to the middle part of the armature, the free end of the contact spring carrying a contact piece embracing the armature and the core yoke and interacting at that side of the core yoke opposite the armature with at least one cooperating contact plate anchored in the coil body.

Deriving as a result of the inventive design of the core yoke and of the armature and of their disposition relative to one another is a very large coupling surface between armature and core in comparison to the overall size of the relay, whereby high contacting forces can be achieved upon low response excitation. Further, the number of piece parts required is kept low due to the direct connection of the contact spring to the armature. The direct actuation of the contact spring at the armature and its U-shaped curvature toward the contact location enables a relative motion of its contacting end in two directions, so that the friction thereby attained enables a good self-cleaning effect of the contact surfaces even given very low switching currents. The opposing disposition of armature and contact unit at both sides of the core yoke is also particularly beneficial. The free spaces prescribed by the coil winding and the core yoke are optimally exploited in this fashion.

In an advantageous further development of the invention, the contact spring simultaneously serves as a bearing spring for the armature and is connected both to the armature as well as to the core yoke for this purpose. This connection can be produced, for example, by means of rivetting or welding. In extension of the junction with the core yoke, the contact spring comprises an applied terminal lug in a practical embodiment. In another embodiment, however, a terminal lug can also be provided applied to the core yoke and with a cross-section reduced by stamping under given conditions. In order to achieve a restoring effect of the contact spring against the armature, the contact spring expediently comprises applied and free-punched spring legs by means of which the contact spring embraces the first yoke leg and the first lateral leg of the armature clamp-like. The contact spring can also additionally comprise a stop tab for impact damping when the armature drops out.

In order to achieve a long, free spring length and in order to increase the frictional effect at the contact location, it is provided in a further embodiment that the contact spring proceeds obliquely to the direction of motion of the second lateral leg of the armature, proceeding thusly in that section which laterally embraces the armature. In an expedient development, the relay also comprises two cooperating contact plates at that side of the core yoke opposite the armature, the cooperating contact plates being pluggably secured in grooves of the base body and parallel to one another and to the core yoke, whereby the contacting end of the contact spring is movable between their contact faces. In a practical development, the cooperating contact plates essentially extend between their fastening grooves over the entire coil length, whereby it is not only a very precise fixing of the cooperating contact plates but also a good heat dissipation that are achieved. In an advantageous development, the disposition of the plug-in grooves in the base body is selected such that the pluggable cooperating contact elements can selectively comprise terminal lugs in extension of the plug-in plane or perpendicular to the plug-in plane. The relay can thus be selectively manufactured for upright or for flat assembly.

BRIEF DESCRIPTION OF THE DRAWINGS

The invention shall be explained in greater detail below with reference to exemplary embodiments shown in the drawing. Thereby shown are.

DESCRIPTION OF THE PREFERRED EMBODIMENTS

Figure 2:
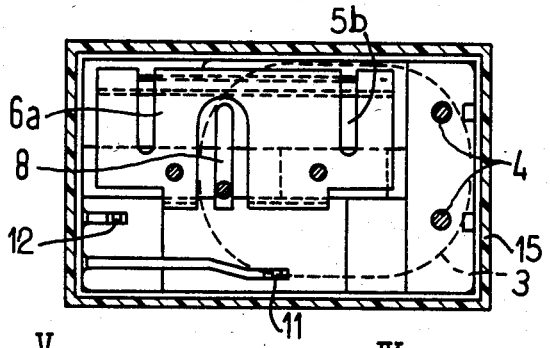
FIG. 2 is a sectional view taken generally along the line II—II of FIG. 1.
Figure 1:
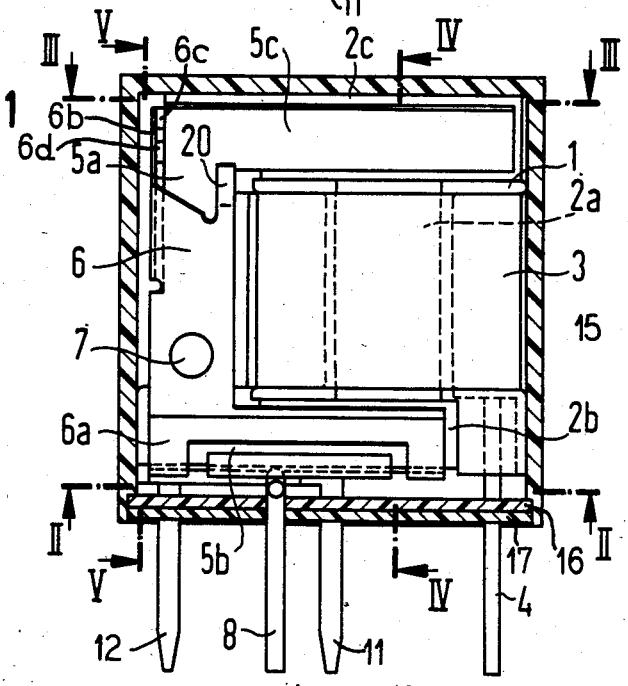
FIG. 1 is a side sectional view of the relay housing and a relay embodying the principles of the present invention.
Figure 3:
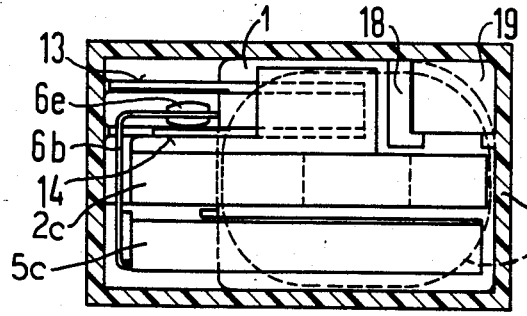
FIG. 3 is a sectional view taken generally along the line III—III of FIG. 1.

The relay illustrated in FIGS. 1 through 6 is a so-called standing embodiment, i.e. terminal pins 4, 8, 11, 12 are conducted out of a housing 15, 16 such that the cuboid relay stands upright in its assembly position and has a small base area. The relay comprises a coil body or base body 1 consisting of insulant, the body being fabricated by means of extrusioncoating a core yoke 2. The core yoke 2 comprises a middle section 2*a* proceeding inside a coil winding 3 and also comprises two yoke legs 2*b* and 2*c* proceeding outside of the coil winding and perpendicular to the coil axis. The yoke leg 2*b* is kept somewhat shorter in order to leave room for coil terminal pins 4 that are anchored in the base body 1. The core yoke 2 is designed as a planar blank and is thus easy and cheap to manufacture. It is extrusion-coated with plastic in order to form the base body 1, whereby this base body can be fabricated very precisely and coming up to requested dimensions on the basis of the metal core yoke despite low wall thicknesses. A large winding space with which the temperature-elevating power consumption can be kept slight at a given excitation can be created with these low wall thicknesses within a prescribed volume.

Figure 4:
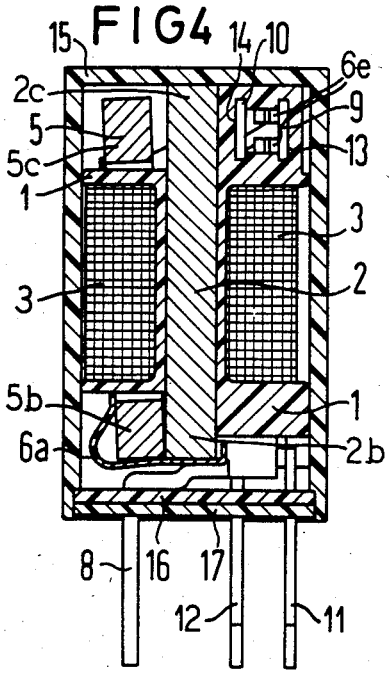
FIG. 4 is a sectional view taken generally along the line IV—IV of FIG. 1.

A U-shaped armature 5 which comprises a middle part 5*a* as well as lateral legs 5*b* and 5*c* of different length shaped in conformity with the two yoke legs 2*b*, 2*a* is disposed on the core yoke 2. The armature 5, like the core yoke 2, is also cut from a planar sheet. The armature 5 has its first lateral leg 5*b* seated on the first yoke leg 2*b* such that the armature can execute a pivot motion around an axis of pivot that is perpendicular to the coil axis and has its second lateral leg 5*c* form a working air gap relative to the second yoke leg 2*c* (FIG. 4). The yoke leg 2*c* and the armature leg 5*c* extend over the entire width of the relay, thereby resulting in a large pole surface. A relatively high response sensitivity can thereby be achieved even upon a large armature stroke.

A contact spring 6 having a button rivet 7 is secured to the middle part 5*a* of the armature, the contact spring 6 simultaneously serving as a bearing spring for the armature 5. A partially free-punched and arc-shaped spring section 6*a* of the contact and bearing spring 6 embraces the first armature leg 5*b* and the first yoke leg 2*b* clamp-like and is secured to the yoke leg 2*b* by means of welding. The restoring force of the armature is set by the bias of this spring section 6*a*. The spring power tolerances can be suppressed by means of aligning the parts before welding to the yoke leg 2*b*. A connection spike 8 is also secured to the spring section 6*a* by means of welding, the spike 8 being routed inside the housing and conducted toward the outside in the desired grid pattern.

Figure 5:
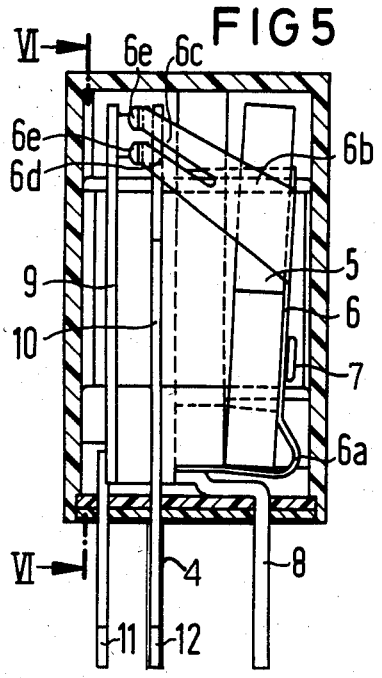
FIG. 5 is a sectional view taken generally along the line V—V of FIG. 1.
Figure 6:
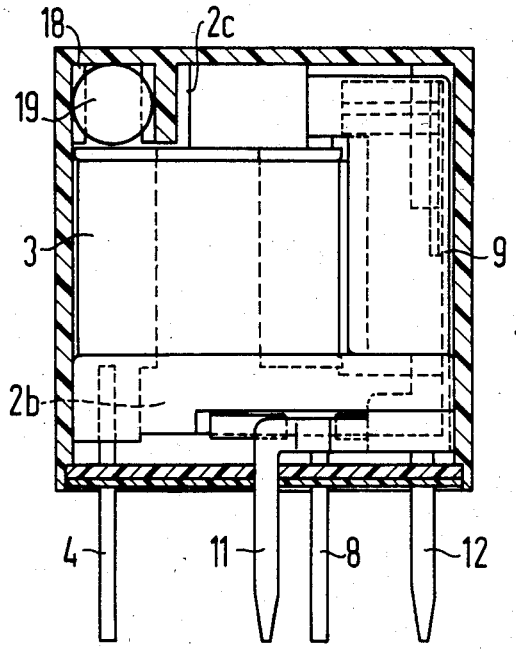
FIG. 6 is a sectional view taken generally along the line VI—VI of FIG. 5.

A U-shaped contacting section 6*b* of the contact spring 6 encompasses the armatures and the core yoke 2 laterally such that it is switchable between two cooperating contact plates 9 and 10 as a center contact spring at the side of the core yoke 2 lying opposite the armature (FIG. 5). The contact spring 6 is thereby split into two contacting ends 6*c* and 6*d* carrying a respective contact piece 6*e* in order to achieve a double contacting.

The cooperating contact plates 9 and 10 are also executed as planar cut parts, are provided with applied or welded terminal lugs 11 and 12, respectively, and are plugged into corresponding grooves 13 and 14, respectively, of the base body 1 and retained there by means of press fit. Due to the relatively large surface of the contact plates 9 and 10, they are capable of allowing the heat arising in the contact circuit to dissipate and be emitted. The cooperating contact plates 9 and 10 can be easily manufactured as planar blanks; they are plated with precious metal only in the contact region. The relative motion of the contact spring 6 yields a good self-cleaning effect at the contact surfaces, the relative motion being possible in two mutually perpendicular directions due to the shaping of the contact spring and its fastening to the armature.

The relay is inserted into a housing that is formed by a protective cap 15 and a base 16. The housing is sealed by means of an additionally applied fleece 17 in the base region which is saturated with curable synthetic resin. A getter chamber 18 is also formed in the protective cap 15 and a getter tablet 19 can be clamped therein.

Figure 7:
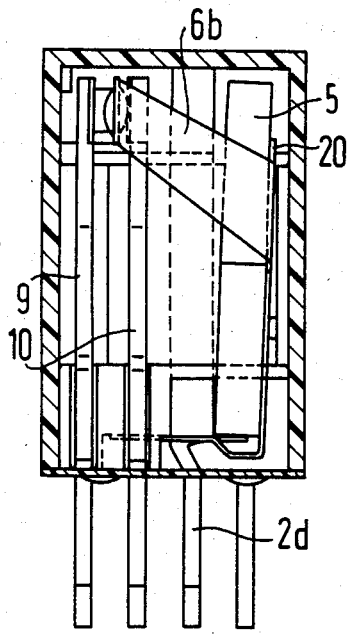
FIG. 7 is a sectional view similar to FIG. 5 of an alternate embodiment of a relay embodying the principles of the invention.
Figure 9:
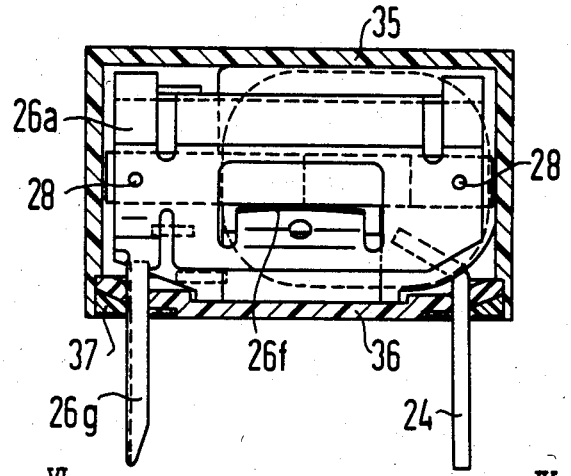
FIG. 9 is a sectional view taken generally along the line IX—IX of FIG. 8.
Figure 8:
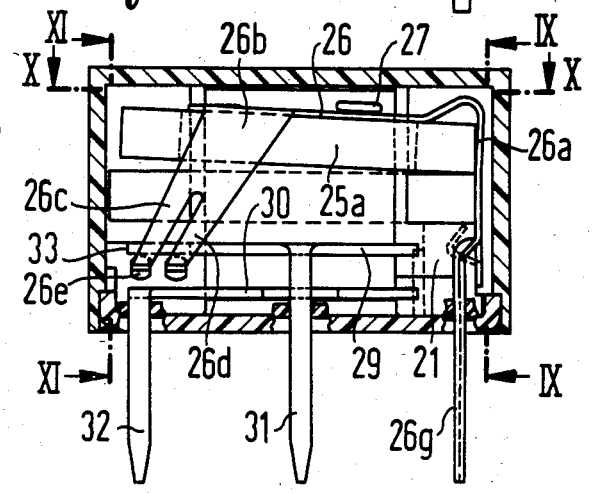
FIG. 8 is a sectional view of an alternate embodiment of a relay embodying the principles of the invention.
Figure 10:
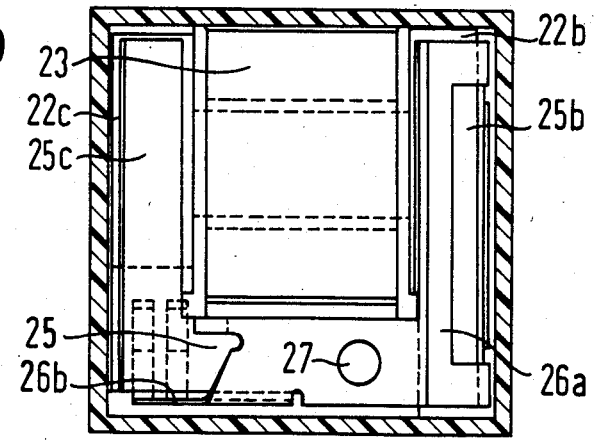
FIG. 10 is a sectional view taken generally along the line X—X of FIG. 8.
Figure 11:
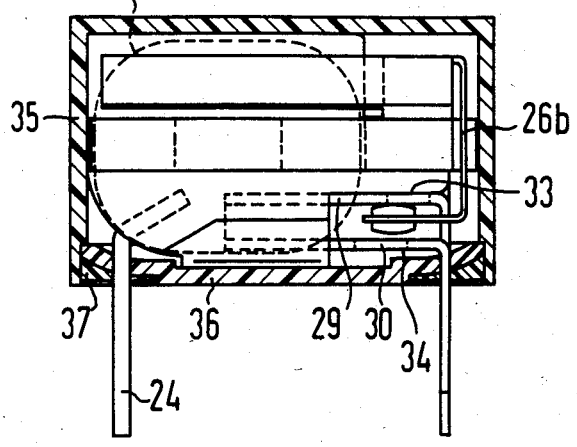
FIG. 11 is a sectional view taken generally along the line XI—XI of FIG. 8.
Figure 12:
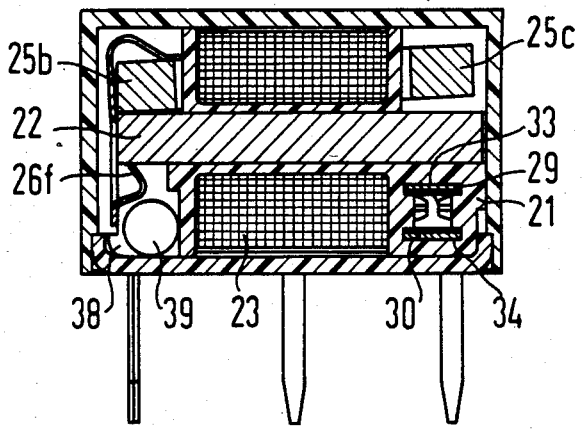
FIG. 12 is a sectional view taken from an opposite side of that shown in FIG. 8.

FIG. 7 shows a slightly modified embodiment in an illustration conforming to that of FIG. 5. Instead of an additional terminal pin 8, the core yoke in FIG. 7 is provided with an applied and stamped extension 2*d* which serves as a connection spike for the contact spring 6. In this case, the contact spring forms an additionally applied impact tooth 20 which damps the recoil of the armature when the excitation is shut down and which thus alleviates contact jolts of the break contact. Otherwise, the relay is constructed similar to that already described with reference to FIGS. 1 through 6.

The relay illustrated in FIGS. 8 through 12 has essentially the same basic structure as that described above; however, based particularly on modification of the terminal pins, it is designed such that it is suitable for recumbent assembly with low overall height. This relay comprises a base body 21 with an embedded core yoke 22 which carries a winding 23. The core yoke comprises two yoke legs 22*b* and 22*c*, whereby a U-shaped armature 25 has a first lateral leg 25*b* seated on the yoke leg 22*b* and has its second lateral leg 25*c* forming a working air gap relative to the yoke leg 22*c*. A contact and bearing spring 26 is secured to the middle section 25*a* of the armature 25 by means of a rivet 27; its arc-shaped spring section 26*a* encompasses the armature leg 25*b* and the yoke leg 22*b* and is secured to the yoke leg 22*b* by means of spot welds 28. An additionally applied spring tab 26*f* that engages at the underside of the yoke leg 22*b* serves for pre-fixing. A terminal pin 26*g* is also co-applied to the contact spring 26.

As in the example described above, a U-shaped section 26*b* of the contact spring embraces the armature and the core yoke and its free end is split into two contacting end sections 26*c* and 26*d* which each carry a respective contact piece 26*e*. It can be switched between the two cooperating contact plates 29 and 30 therewith. The latter are provided with orthogonally bent terminal lugs 31 and 32, respectively, and are plugged into grooves 33 and 34, respectively, of the base body 21 for fastening.

A protective cap 35 with a base 36 serves as a housing, whereby the edge groove or, respectively, the passages for the terminal pins are sealed with casting compound 37. A chamber 38 for the acceptance of a getter tablet 39 is also provided in the base body.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. An electromagnetic relay comprising:

a base body carrying a coil winding, a core yoke having its center section embedded in said base body and which has a yoke leg extending perpendicular to the coil axis at both ends outside of said coil winding;

a U-shaped armature seated on said core yoke, the central part thereof residing parallel to the coil axis and embracing said coil winding, and its two lateral legs extending essentially perpendicular to said coil axis;

said armature having its first lateral leg seated on the first yoke leg so as to be pivotable around an axis perpendicular to said coil axis and having its second lateral leg forming a working air gap relative to the second yoke leg; and a contact spring secured to the middle part of said armature, the free end of said contact spring carrying a contact piece embracing said armature and said core yoke and interacting at that side of said core yoke opposite said armature with a least one cooperating contact plate anchored in said base body.

2. The relay according to claim 1, wherein the contact spring, as a bearing spring, is connected both to the armature as well as to the core yoke.

3. The relay according to claim 1 wherein the core yoke forms a stamped continuation as a terminal lug for the contact spring.

4. The relay according to claim 1 wherein the contact spring forms a terminal lug in extension of the fastening point to the core yoke.

5. The relay according to claim 1 wherein the contact spring embraces the first yoke leg and the first lateral leg of the armature clamp-like by means of applied and free-punched spring legs.

6. The relay according to claim 1, wherein a stop tab damping the armature drop-out is formed as part of the contact spring.

7. The relay according to claim 5, wherein that section of the contact spring which laterally embraces the armature proceeds obliquely relative to the direction of motion of the contact pieces.

8. The relay according to claim 1, wherein two cooperating contact plates are pluggably secured parallel to one another and to the core yoke in grooves of the base body at that side of the core yoke which is opposite the armature, the contacting end of the contact spring being movable between the contact surfaces of said cooperating contact plates.

9. The relay according to claim 8, wherein the cooperating contact plates essentially extend over the entire coil length.

10. The relay according to claim 9, wherein the cooperating contact plates have terminal lugs which selectively proceed in extension of the plug-in plane or perpendicular to said plug-in plane and can be plugged into the base body.

11. An electromagnetic relay comprising:

a core yoke with a center section and a yoke leg at each end extending perpendicular to said center section, a base body surrounding and embedding said yoke center section and carrying a coil winding, a U-shaped armature seated on said yoke core with a central portion extending parallel to the coil winding axis and two lateral legs extending perpendicular to said coil axis, a first of said lateral armature legs seated on a first yoke leg so as to be pivotable around an axis perpendicular to said coil axis, a second of said lateral armature legs adjacent, but spaced from a second yoke leg, and a contact spring secured to the central portion of said armature, the free end of said contact spring carrying a contact piece embracing said armature and said core yoke and interacting at a side of said core yoke opposite said armature with at least one cooperating contact plate anchored in said base body.

* * * * *